United States Patent [19]

Davis

[11] 4,076,123

[45] Feb. 28, 1978

[54] DISPOSABLE PLASTIC LID

[75] Inventor: Paul Davis, Swampscott, Mass.

[73] Assignee: Sweetheart Plastics, Inc., Wilmington, Mass.

[21] Appl. No.: 696,935

[22] Filed: Jun. 17, 1976

[51] Int. Cl.[2] ..... B65D 21/00; B65D 85/62

[52] U.S. Cl. ..... 206/503; 206/520; 220/380

[58] Field of Search ..... 220/380; 206/503, 508, 206/515, 519, 520; 229/43

[56] References Cited

U.S. PATENT DOCUMENTS

| | | | |
|---|---|---|---|
| 3,179,283 | 4/1965 | Amberg | 220/380 |
| 3,321,104 | 5/1967 | Edwards | 206/503 |
| 3,701,456 | 10/1972 | Alroy | 206/520 |
| 3,931,890 | 1/1976 | Davis | 206/515 |
| 3,954,178 | 5/1976 | Mason | 206/508 |

*Primary Examiner*—George E. Lowrance

*Attorney, Agent, or Firm*—Wolf, Greenfield & Sacks

[57] ABSTRACT

A thin wall disposable plastic lid designed to stack with other substantially identical lids without compacting having a circular closure wall and a surrounding downwardly extending skirt. A pair of downwardly extending, closely spaced, annular ribs are formed in the circular closure wall, and a plurality of upwardly extending bosses are also formed in the closure wall and span the space between the ribs. The bosses engage the bottom of the ribs of the next upper lid in the stack when nested to prevent the lids from jamming together.

4 Claims, 4 Drawing Figures

DISPOSABLE PLASTIC LID

INTRODUCTION AND BACKGROUND

This invention relates to container covers and more particularly comprises a disposable plastic lid having new and improved stacking features that enable a number of identical lids to be arranged in a stack without compacting or jamming.

There are a very wide variety of disposable plastic lids used in the food packaging industry, and these lids are generally provided with some form of stacking facility which enables the lids to be stacked with other identical or substantially identical lids without compacting or jamming even when axially directed loads are imposed on them. Very frequently the stacking facilities take the form of undercuts to provide a positive interference between the engaging portions of adjacent lids. Undercuts have an obvious disadvantage, namely, they make it difficult to strip the lids from the molds after they are thermoformed. The more pronounced the undercut (which provides greater stacking interference), the more difficult are the forming and stripping operations. In accordance with this invention, undercuts in the principal stacking facility are eliminated.

The lid of the present invention is provided with a circular closure wall and a depending skirt. A rim cavity is formed at the junction of the circular wall and skirt, which receives the container rim to form a seal when the lid is placed on the container. A pair of spaced annular ribs are formed in the closure wall adjacent its periphery, and the space between the ribs defines a raised rib or inverted trough. Extending upwardly from the trough are symetrically spaced bosses which are wider than the trough so as to extend into the parallel ribs. When like ribs are stacked one upon the other in the upright position, the upwardly extending bosses in the lower lid engage the bottoms of the parallel ribs of the next upper lid in the stack to prevent the lids from compacting or jamming together. Consequently they are easily separated for use.

This particular configuration has several advantages. First, because the stacking facility defined by the ribs, trough and bosses is free of undercuts, the mold is not difficult to fabricate, and the lids are easy to strip from the mold during manufacture. Second, the stacking facility is free of any substantial downwardly extending projections that would extend into the contents of the container to which the lid is applied. Third, because the bosses are effectively shortened by the intersection by the trough, there is less thinning of the material during the thermal forming operation. That is, the mouth to depth ratio of the draw in the mold during forming is reduced so that the bosses are not weakened or thinned excessively. Fourth, the upwardly extending bosses are not sealed at the bottom by the ribs in the next lower lid in a stack. Consequently, the bosses are vented and no vacuum is formed which would resist lid separation. Fifth, the interruption of the bosses by the trough assists in the evacuation of air from the mold during forming so as to eliminate air distortion.

The objects, features and advantages of this invention will be better understood and appreciated from the following detailed description read in connection with the accompanying drawing.

BRIEF FIGURE DESCRIPTION

DETAILED DESCRIPTION

Figure 1:
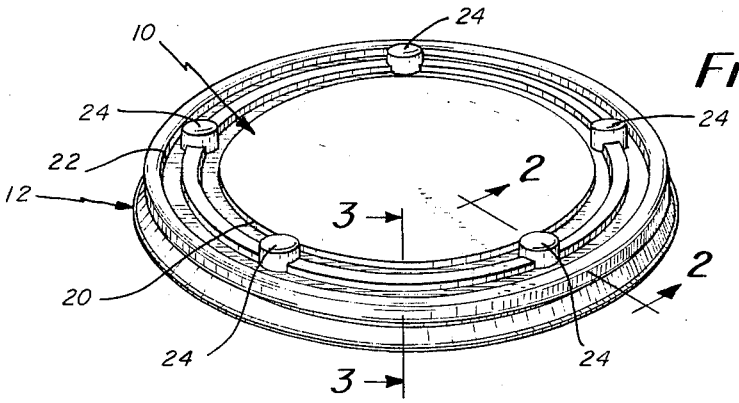
FIG. 1 is a perspective view of a lid constructed in accordance with this invention.

The lid shown in the drawing includes a circular closure wall 10 and a surrounding skirt 10 joined together at the corner 14 that forms part of the seat for the bead of a container (not shown) closed by the lid. Typically the lid is thermoformed from thin sheet plastic having a thickness of approximately 0.004 inch.

A shallow annular recess 16 is formed in the closure wall 10 adjacent edge 14. The recess is defined by a bottom wall 18 and inner and outer side walls 20 and 22. The recess 16 may be approximately 0.047 inch in depth measured from the upper surface of the closure wall 10 to the upper surface of the bottom wall 18. A plurality of upwardly extending cylindrical bosses 24 each defined by a top wall 26 and a cylindrical wall 28 are spaced about the recess 16 intermediate the inner and outer walls 20 and 22. As is apparent in FIG. 2, the upper surface 26 of each boss lies in a plane above the closure wall 10.

An inverted trough or rib 30 extends about recess 16 and intersects the cylindrical walls 28 of the several bosses. The inverted trough 30 defined by top wall 32 and inner and outer side walls 34 and 36 has a radial extent somewhat less than the diameter of the bosses 24 for reasons that will be made apparent presently. Typically the inverted trough 30 may be approximately 0.047 inch in height so that the top wall 32 is co-planar with the remaining portions of the closure wall 10, and the width of the inverted trough may be approximately 0.084 inch. The diameter and height of the bosses in turn may typically be 0.25 and 0.128 inches.

Figure 2:
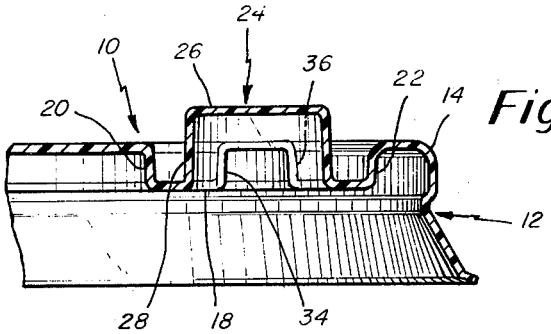
FIGS. 2 and 3 are cross-sectional views taken along the corresponding section lines in FIG. 1.
Figure 3:
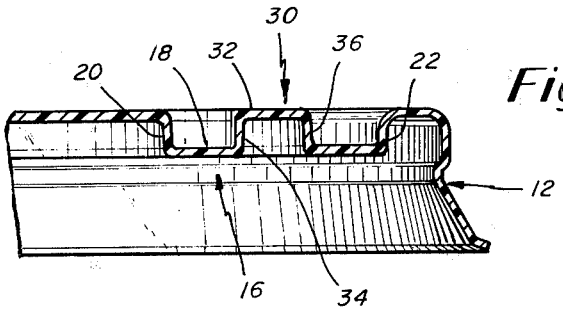
Figure 4:
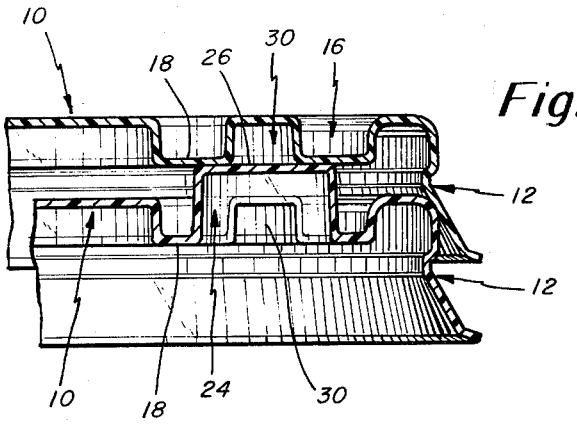
FIG. 4 is a fragmentary cross-sectional view of two lids stacked on upon the other.

In FIG. 4 a pair of identical lids as shown in FIGS. 1–3 are illustrated nested together in a stack. It will be observed in that figure that the upper surface 26 of boss 24 engages the lower surface 18 of the shallow recess 16 in the next upper lid. The lids are shown circumferentially displaced so that the boss of the bottom lid is not aligned with the boss of the top lid. Because the boss 24 as shown in FIG. 4 has a greater radial extent that the trough 30 of the upper lid, the boss spans the trough 30 of the upper lid and does not compact with it. That is, the boss cannot extend into the trough 30 of the next upper lid so as to cause the two to stick together.

Ordinarily the lids of the present invention are made in multi-cavity molds, and it is contemplated that the lids formed in the different cavities will have different numbers of bosses. For example, different cavities may produce lids having five, six, seven, eight or nine bosses in the respective lids. When the lids are packaged, a procedure is ordinarily adopted which results in lids of different numbers of bosses being stacked in sequence. Consequently, even when the lids become circumferentially aligned so that one boss in each of two adjacent lids are aligned with one another, not all of the bosses in the adjacent lids will be so aligned and consequently the bosses will engage the lower surface of the recess of the next upper lid so as to prevent the lids from compacting.

In the embodiment shown, the skirt 12 of the upper lid is engaged by the corner 14 of the next lower lid.

This engagement primarily provides lateral stability for the stack by preventing the lids from sliding sideways on one another.

From the foregoing description it will be appreciated that the several advantages attributed to this invention in the introduction are achieved. For example, the inverted troughs which intersect the bosses prevent vacuums from being created between adjacent lids which would make separation of the lids difficult. Furthermore, the troughs facilitate the drawing of the bosses by reducing the thinning out of the material which occurs. And difficult to form undercuts are avoided.

Having described this invention in detail those skilled in the art will appreciate that modifications may be made thereof without departing from the spirit of the invention. Therefore, it is not intended that the scope of this invention be limited to the specific embodiment illustrated and described. Rather, it is intended that the scope of this invention be determined by the appended claims and their equivalents.

What is claimed is:

1. A thin wall disposable plastic lid for covering containers and designed to stack with other substantially identical lids without compacting comprising a circular closure wall and a surrounding downwardly extending skirt, a recess formed about the closure wall by downwardly depending generally encircling walls and a recess bottom, a pair of upwardly extending and closely spaced annular walls defining a raised rib formed in the recess and concentric with the closure wall, said raised rib in turn defining in part two concentric downwardly extending ribs in said recess, and a plurality of upwardly extending bosses formed in the recess and aligned with the space defined by and extending over the annular walls of the raised rib, said bosses being radially wider than said space to span said space and engage the bottoms of the downwardly extending ribs of a like lid stacked on it to prevent the lids from compacting when an axial directed force is applied to like lids.

2. A thin wall disposable plastic lid as defined in claim 1 further characterized by said bosses being generally cylindrical in shape and defining a top wall raised above said closure wall with said raised rib forming an inverted trough.

3. A thin wall disposable plastic lid as defined in claim 1 further characterized by said bosses being equidistant from one another about the wall.

4. A thin wall disposable plastic lid as defined in claim 1 further characterized by said rib and bosses being disposed adjacent the skirt.

* * * * *